US007596491B1

(12) United States Patent
Stachurski

(10) Patent No.: US 7,596,491 B1
(45) Date of Patent: Sep. 29, 2009

(54) LAYERED CELP SYSTEM AND METHOD

(75) Inventor: Jacek Stachurski, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 743 days.

(21) Appl. No.: 11/279,932

(22) Filed: Apr. 17, 2006

Related U.S. Application Data

(60) Provisional application No. 60/673,300, filed on Apr. 19, 2005, provisional application No. 60/673,010, filed on Apr. 19, 2005.

(51) Int. Cl.
*G10L 19/04* (2006.01)

(52) U.S. Cl. ..... 704/219; 704/203; 704/220; 704/223

(58) Field of Classification Search ..... 704/219, 704/203, 220, 223
See application file for complete search history.

(56) References Cited

U.S. PATENT DOCUMENTS

| | | | | |
|---|---|---|---|---|
| 5,671,327 | A * | 9/1997 | Akamine et al. | 704/219 |
| 5,778,335 | A * | 7/1998 | Ubale et al. | 704/219 |
| 6,813,602 | B2 * | 11/2004 | Thyssen | 704/222 |
| 2005/0010400 | A1 * | 1/2005 | Murashima | 704/219 |
| 2005/0137864 | A1 * | 6/2005 | Valve et al. | 704/227 |

* cited by examiner

*Primary Examiner*—Qi Han
(74) *Attorney, Agent, or Firm*—Mirna G. Abyad; Wade J. Brady, III; Frederick J. Telecky, Jr.

(57) ABSTRACT

Layered (embedded) code-excited linear prediction (CELP) speech encoders/decoders with adaptive plus algebraic codebooks applied in each layer with fixed codebook pulses of one layer used in higher layers. Pulse weightings emphasize lower layer pulses relative to the higher layer pulses.

9 Claims, 5 Drawing Sheets

LAYERED CELP SYSTEM AND METHOD

CROSS-REFERENCE TO RELATED APPLICATIONS

This application claims priority from provisional patent applications Nos. 60/673,010 and 60/673,300, both filed Apr. 19, 2005. The following patent application discloses related subject matter: Ser. No. 10/054,604, filed Nov. 13, 2001. These referenced applications have a common assignee with the present application.

BACKGROUND OF THE INVENTION

The invention relates to electronic devices and digital signal processing, and more particularly to speech encoding and decoding.

The performance of digital speech systems using low bit rates has become increasingly important with current and foreseeable digital communications. Both dedicated channel and packetized voice-over-internet protocol (VoIP) transmission benefit from compression of speech signals. The widely-used linear prediction (LP) digital speech coding method models the vocal tract as a time-varying filter and a time-varying excitation of the filter to mimic human speech. Linear prediction analysis determines LP coefficients a(j), j=1, 2, . . . , M, for an input frame of digital speech samples {s(n)} by setting $$r(n)=s(n)-\Sigma_{M\geqq j\geqq 1}a(j)s(n-j) \quad (1)$$

and minimizing $\Sigma_{frame}r(n)^2$. Typically, M, the order of the linear prediction filter, is taken to be about 10-12; the sampling rate to form the samples s(n) is typically taken to be 8 kHz (the same as the public switched telephone network (PSTN) sampling for digital transmission and which corresponds to a voiceband of about 0.3-3.4 kHz); and the number of samples {s(n)} in a frame is often 80 or 160 (10 or 20 ms frames). Various windowing operations may be applied to the samples of the input speech frame. The name "linear prediction" arises from the interpretation of the residual $r(n)=s(n)-\Sigma_{M\geqq j\geqq 1}a(j)s(n-j)$ as the error in predicting s(n) by a linear combination of preceding speech samples $\Sigma_{M\geqq j\geqq 1}a(j)s(n-j)$; that is, a linear autoregression. Thus minimizing $\Sigma_{frame}r(n)^2$ yields the {a(j)} which furnish the best linear prediction. The coefficients {a(j)} may be converted to line spectral frequencies (LSFs) or immittance spectrum pairs (ISPs) for vector quantization plus transmission and/or storage.

The {r(n)} form the LP residual for the frame, and ideally the LP residual would be the excitation for the synthesis filter 1/A(z) where A(z) is the transfer function of equation (1); that is, equation (1) is a convolution which z-transforms to multiplication: R(z)=A(z)S(z), so S(z)=R(z)/A(z). Of course, the LP residual is not available at the decoder; thus the task of the encoder is to represent the LP residual so that the decoder can generate an excitation for the LP synthesis filter. That is, from the encoded parameters the decoder generates a filter estimate, $\hat{A}(z)$, plus an estimate of the residual to use as an excitation, E(z); and thereby estimates the speech frame by $\hat{S}(z)=E(z)/\hat{A}(z)$. Physiologically, for voiced frames the excitation roughly has the form of a series of pulses at the pitch frequency, and for unvoiced frames the excitation roughly has the form of white noise.

For compression the LP approach basically quantizes various parameters and only transmits/stores updates or codebook entries for these quantized parameters, filter coefficients, pitch lag, residual waveform, and gains. A receiver regenerates the speech with the same perceptual characteristics as the input speech. Periodic updating of the quantized items requires fewer bits than direct representation of the speech signal, so a reasonable LP coder can operate at bits rates as low as 2-3 kb/s (kilobits per second).

Indeed, the Adaptive Multirate Wideband (AMR-WB) standard with available bit rates ranging from 6.6 kb/s up to 23.85 kb/s uses LP analysis with codebook excitation (CELP) to compress speech. FIGS. 2*a*-2*b* illustrate the AMR-WB encoder functional blocks. The adaptive-codebook contribution provides periodicity in the excitation and is the product of a gain, $g_P$, multiplied by v(n), the excitation of the prior frame translated by the pitch lag of the current frame and interpolated. The algebraic codebook contribution approximates the difference between the actual residual and the adaptive codebook contribution with a multiple-pulse vector (innovation sequence), c(n), multiplied by a gain, $g_C$; the number of pulses depends upon the bit rate. That is, the excitation is $u(n)=g_Pv(n)+g_Cc(n)$ where v(n) comes from the prior (decoded) frame and $g_P$, $g_C$, and c(n) come from the transmitted parameters for the current frame. The speech synthesized from the excitation is then postfiltered to mask noise. Postfiltering essentially comprises three successive filters: a short-term filter, a long-term filter, and a tilt compensation filter. The short-term filter emphasizes the formants; the long-term filter emphasizes periodicity, and the tilt compensation filter compensates for the spectral tilt typical of the short-term filter. See Bessette et al, The Adaptive Multirate Wideband Speech Codec (AMR-WB), 10 IEEE Tran. Speech and Audio Processing 620 (2002).

Further, FIG. 3 heuristically illustrates a layered (embedded) CELP encoder, such as the MPEG-4 audio CELP, which provides bit rate scalability with an output bitstream consisting of a core (base) layer (adaptive codebook together with fixed codebook 0) plus N enhancement layers (fixed codebooks 1 through N). A layered encoder uses only the core layer at the lowest bit rate to give acceptable quality and provides progressively enhanced quality by adding progressively more enhancement layers to the core layer. Find a layer's fixed codebook entry by minimization of the error between the input speech and the so-far cumulative synthesized speech. This layering is useful for some voice over Internet Protocol (VoIP) applications including different Quality of Service (QoS) offerings, network congestion control, and multicasting. For the different QoS service offerings, a layered coder can provide several options of bit rate by increasing or decreasing the number of enhancement layers. For the network congestion control, a network node can strip off some enhancement layers and lower the bit rate to ease network congestion. For multicasting, a receiver can retrieve appropriate number of bits from a single layer-structured bitstream according to its connection to the network.

CELP coders apparently perform well in the 6-16 kb/s bit rates often found with VoIP transmissions. However, known CELP coders perform less well at higher bit rates in a layered (embedded) coding design. A non-embedded CELP coder can optimize its parameters for best performance at a specific bit rate. Most parameters (e.g., pitch resolution, allowed fixed-codebook pulse positions, codebook gains, perceptual weighting, level of post-processing) are optimized to the operating bit rate. In an embedded coder, optimization for a specific bit rate is limited as the coder performance is evaluated at many bit rates. Furthermore, in CELP-like coders, there is a bit-rate penalty associated with the embedded constraint, a non-embedded coder can jointly quantize some of its parameters, e.g., fixed-codebook pulse positions, while an embedded coder cannot. In an embedded coder extra bits are also needed to encode the gains that correspond to the different bit rates, which require additional bits. Typically, the more embedded enhancement layers that are considered, the larger the bit-rate penalties, and so for a given bit rate, non-embedded coders outperform embedded coders.

SUMMARY OF THE INVENTION

The present invention provides a layered CELP coding with both adaptive and fixed codebook optimizations for each layer and/or with pulses of differing layers having differing weights.

This has advantages including achieving non-layered CELP quality with a layered CELP coding system.

DETAILED DESCRIPTION OF THE PREFERRED EMBODIMENTS

1. Overview

Figure 1A:
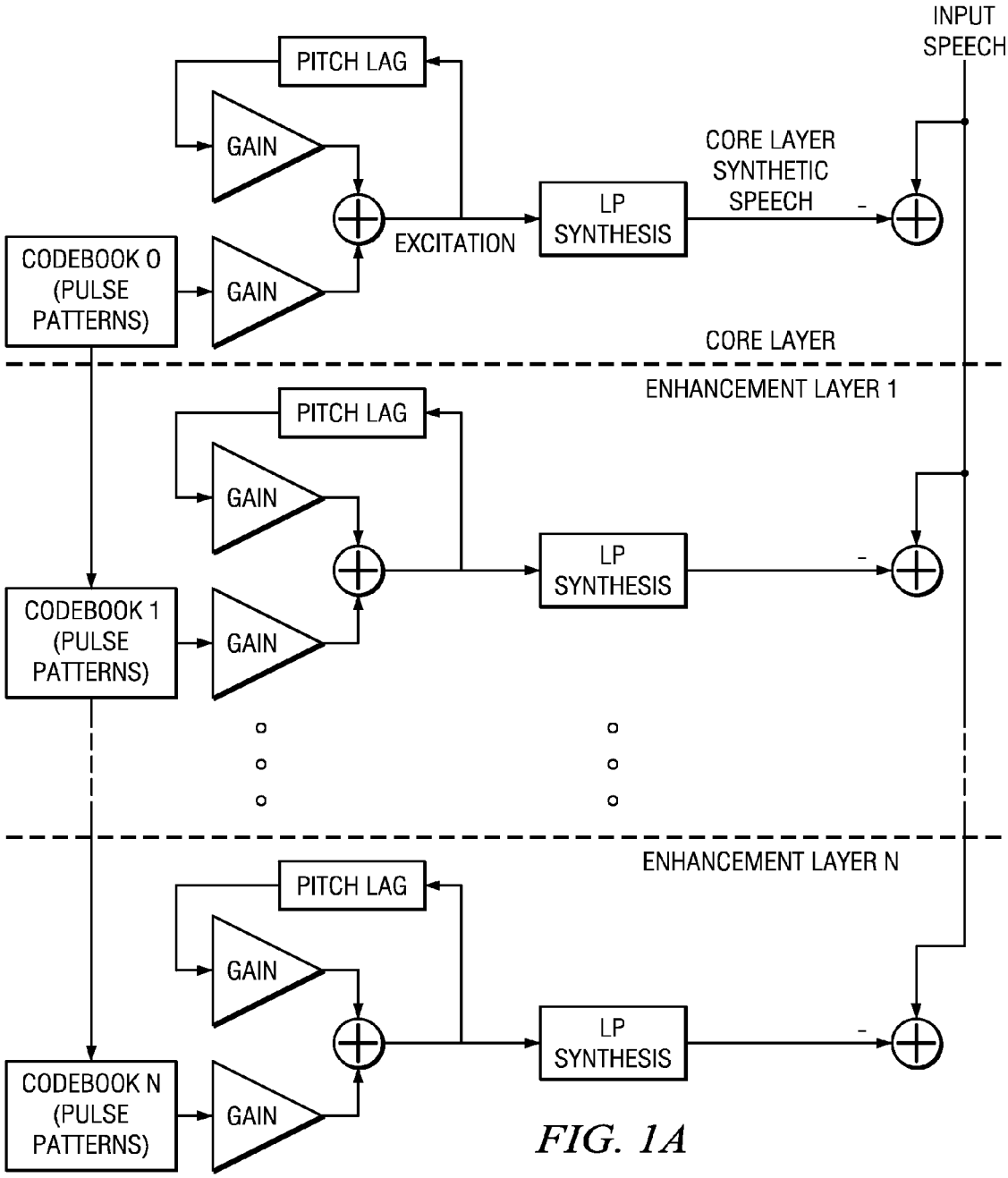
FIGS. 1*a*-1*b* illustrate preferred embodiment encoder.
Figure 1B:
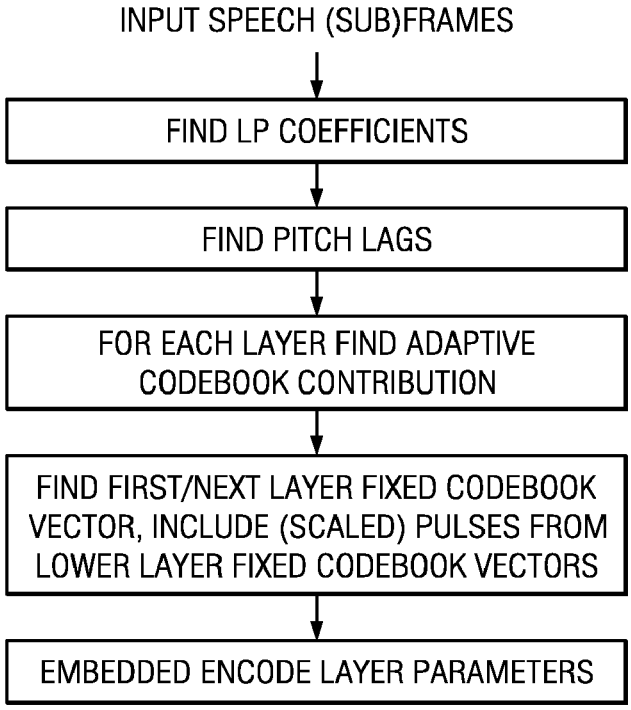

The preferred embodiment encoders and decoders use layered CELP coding with both adaptive and algebraic codebook searches in all layers and/or weighted pulses inherited from lower layers. FIG. 1*a* illustrates a layered encoder with both core (base) and enhancement layers having both adaptive and fixed codebook components.

Preferred embodiment systems use preferred embodiment coding where the coding is performed with digital signal processors (DSPs), general purpose programmable processors, application specific circuitry, and/or systems on a chip such as both a DSP and RISC processor on the same integrated circuit. Codebooks would be stored in memory at both the encoder and decoder, and a stored program in an onboard or external ROM, flash EEPROM, or ferroelectric RAM for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

2. Enhancement Layers with Adaptive Codebook Searches

Figure 2A:
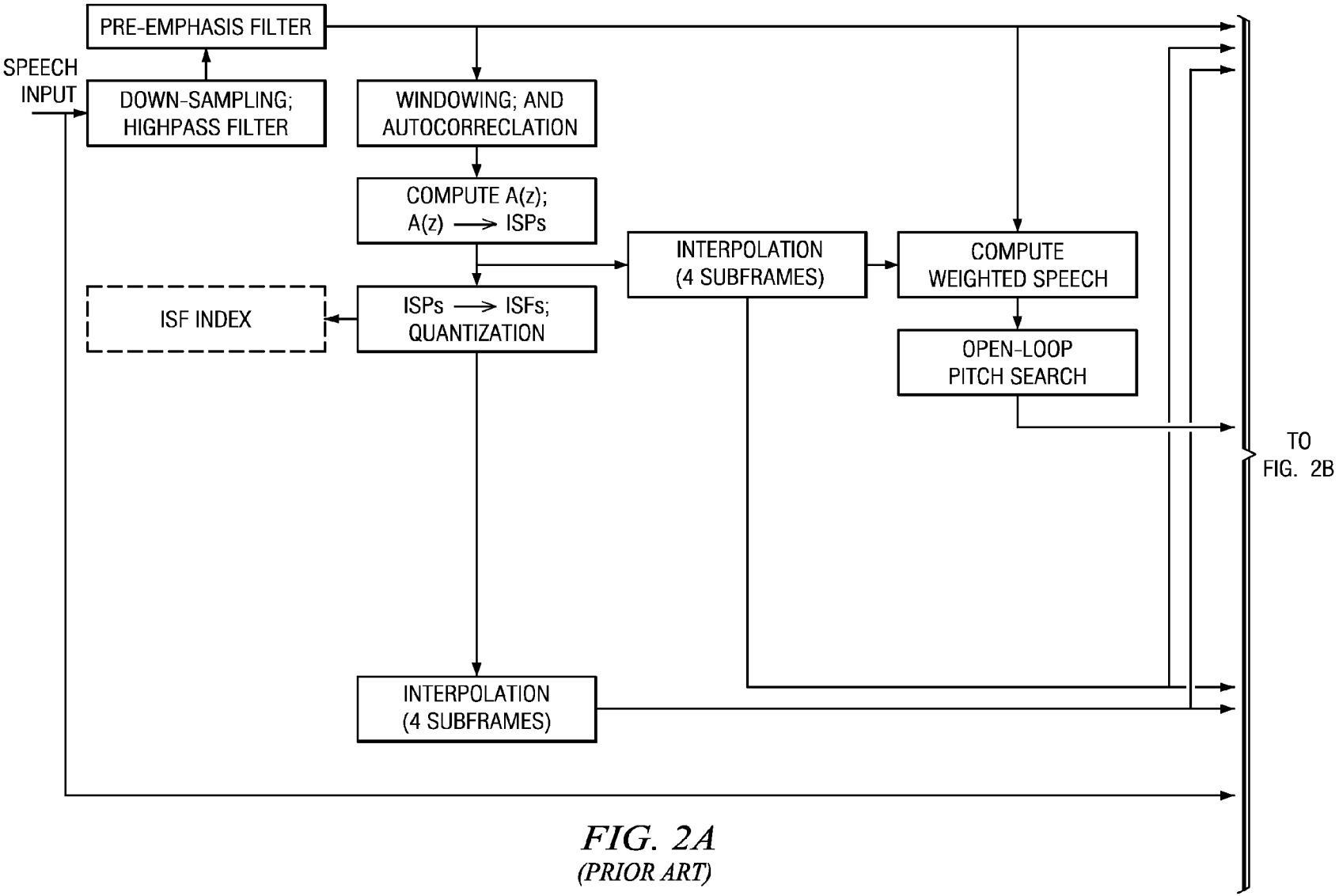
FIG. 2A (PRIOR ART)
FIGS. 2*a*-2*b* show function blocks of an AMR-WB encoder.
Figure 2B:
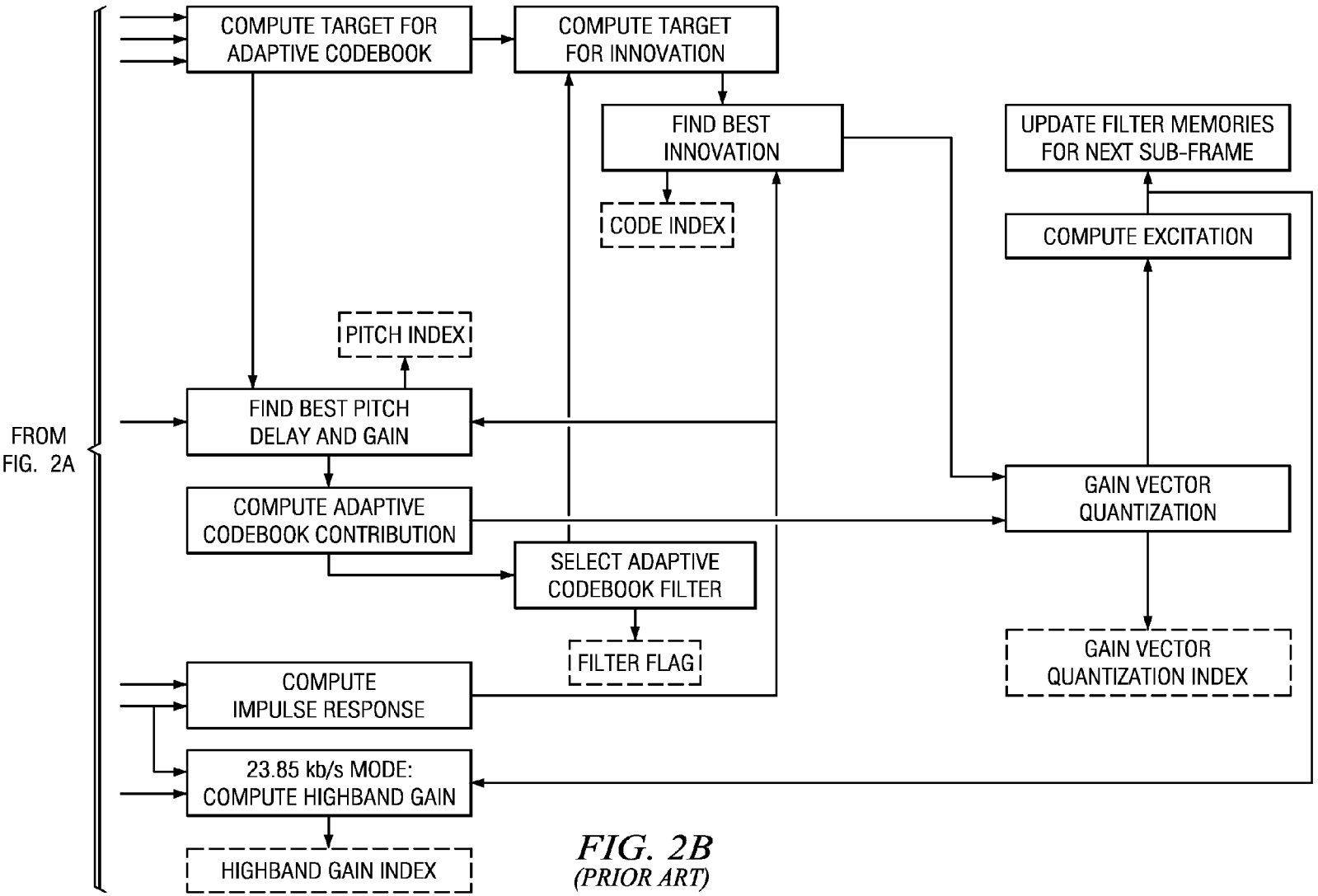
FIG. 2B (PRIOR ART)
Figure 3:
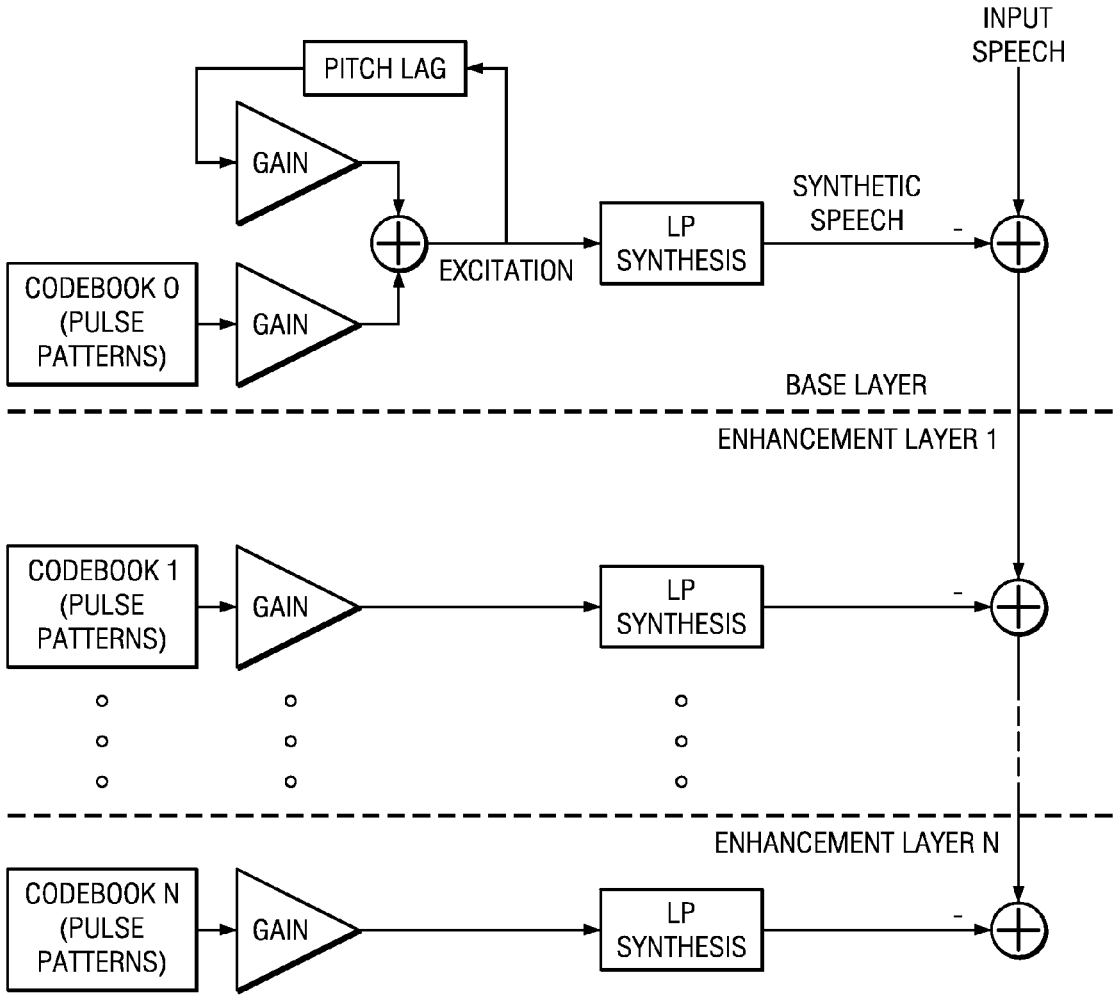
FIG. 3 (PRIOR ART)
FIG. 3 shows known layered CELP encoding.

First consider a layered CELP encoder as illustrated in FIG. 3 in order to explain the preferred embodiments. The core layer (layer 0) has the same structure as a non-layered CELP encoder, such as the AMR-WB encoder of FIGS. 2*a*-2*b*: LP parameter extraction, adaptive and fixed (algebraic) codebook searches with analysis-by-synthesis methods, and quantizations. In each enhancement layer only the fixed codebook parameters (pulses and gains) are analyzed with the analysis-by-synthesis method using an error signal from the lower layers as an input signal target.

In contrast, FIG. 1*a* illustrates a first preferred embodiment which includes an adaptive codebook search in each enhancement layer. That is, each layer of the encoder operates as an "independent" encoder with its own filter memories, adaptive codebooks, target vectors, and adaptive and fixed codebook gains. In each layer, the target vector used for the fixed-codebook pulse selection and calculation of the codebook gains is obtained from the input signal (as in non-embedded CELP) and not from the quantization error generated in a lower layer. Common elements across layers include the pitch lag and, in the upper enhancement layers, fixed-codebook pulses from lower layers.

In particular, first preferred embodiments layered coding has a simplified core layer analogous to AMR-WB with 4 pulses per subframe and adds 4 more pulses in each enhancement layer. The encoding includes the following steps.

(1) Downsample input speech having a 16 kHz sampling rate to a sampling rate of 12.8 kHz; this is a 4:5 downsampling and converts 20 ms frames from 320 samples to 256 samples. Then pre-process with a highpass filter and a pre-emphasis filter with a filter of the form $P(z)=1-\mu z^{-1}$ where $\mu$ may be equal to about 0.68. Perceptual weighting will correct for this in step (3).

(2) For each frame apply linear prediction (LP) analysis to the pre-processed speech, s(n), and find the analysis filter A(z). Convert the set of LP parameters to immittance spectrum pairs (ISP) and immittance spectral frequencies (ISF) and vector quantize the ISFs. In step (3) each frame will be partitioned into four subframes of 64 samples each for adaptive and fixed codebook parameter extractions; interpolate the ISPs and quantized ISFs to define LP parameters for use in these subframes. All layers use the same LP parameters.

(3) In analysis-by-synthesis encoders the adaptive and fixed codebook searches minimize the error between perceptually-weighted input speech and synthesized speech. Thus, in each subframe apply a perceptually-weighted filter W(z) to the pre-processed speech where the perceptual weighting filter $W(z)=A(z/\gamma_1)/(1-\gamma_2 z^{-1})$; this yields $s_w(n)$. Note that the coefficients of A( ) for the subframe derive from the interpolation of step (2). This same perceptual-weighting-filtered speech signal will be used in both the core layer and the enhancement layers. The perceptual-weighted filtering masks quantization noise by shaping the noise to appear near formants where the speech signal is stronger and thereby give better results in the error minimization which defines the estimation. The parameters $\gamma_1$ and $\gamma_2$ determine the level of noise masking ($1>\gamma_1>\gamma_2>0$). In general, a low bit rate CELP encoder uses the perceptual weighting filter with stronger noise masking (e.g., $\gamma_1=0.9$ and $\gamma_2=0.5$) while a high bit rate CELP encoder uses a filter with weaker noise masking (e.g., $\gamma_1=0.9$ and $\gamma_2=0.65$).

(4) Use the same pitch lag for all layers; thus only compute the pitch lag in the core layer. The pitch lag determination has three stages: (i) estimate an open-loop integer pitch lag, $T_O$, every 10 ms (first and third subframes) by maximizing the autocorrelation of $s_w(n)$, (ii) do a closed-loop pitch search for integer pitch lags close to $T_O$, and (iii) refine the integer pitch lag with fractional lags. Constrain the pitch lag to lie in the range [34, 231] which corresponds to the frequency range of 55 to 377 Hz. In more detail, these steps are as follows:

(i) Estimate an open-loop integer pitch lag $T_O$ by maximizing a normalized autocorrelation of the perceptually-weighted filtered pre-processed speech. Thus first define:

$$R'(k)=\Sigma_{0\leq n\leq 127}s_w(n)s_w(n-k)/\sqrt{(\Sigma_{0\leq n\leq 127}s_w(n-k)s_w(n-k)}$$

Then take the open-loop delay as $T_O=\arg\max_k R'(k)$.

(ii) Refine the open-loop delay, $T_O$, with a closed-loop search which minimizes the synthesis error; this equates to maximizing with respect to integer k in a range of ±7 about $T_O$ of the normalized correlation of the synthesized speech with the target speech. Thus first define the normalized correlation:

$$R(k)=\Sigma_{0\leq n\leq 63}x(n)y_k(n)/\sqrt{(\Sigma_{0\leq n\leq 63}y_k(n)y_k(n))}$$

where x(n) is the target signal and $y_k(n)$ is the synthesis of filtering the prior excitation at lag k (i.e., translated by a subframe and k) through the weighted synthesis filter W(z)/Â(z) with 1/Â(z) the synthesis filter with quantized LP coefficients. The signal $y_k(n)$ is computed by convolution of prior excitation at lag k of the core layer (layer 0) with the impulse response of the weighted synthesis filter. Compute the target signal, x(n), by first applying the analysis filter, A(z), to the pre-processed speech, s(n), to yield the residual, r(n), and then apply the weighted synthesis filter W(z)/Â(z) to r(n) which gives x(n). Then the closed-loop optimal integer delay is arg $\max_k R(k)$.

(iii) Once the optimal integer delay is found, compute a fractional refinement for the fractions from −¾ to +¾ in steps of ¼ about the optimal integer delay by maximization of interpolated correlations. In particular, let $b_{36}(n)$ be a Hamming windowed sinc function filter truncated at ±35, and define:

$$R(k;m)=\Sigma_{0\leq j\leq 8}R(k-j)b_{36}(m+4j)+\Sigma_{0\leq j\leq 8}R(k+1+j)b_{36}(4-m+4j)$$

where k is the optimal integer delay and m=0, 1, 2, 3 corresponds to fractional delays 0, ¼, ½, ¾, respectively. Then the fractional delay for integer delay k corresponds to arg $\max_m R$ (k; m), and the pitch lag in the subframe for all layers is the sum of the optimal integer delay plus this fractional delay.

(5) For each layer L (L=0, 1, 2, . . . , N) compute the adaptive codebook vector, $v_L(n)$, as the prior subframe layer L excitation ($u_{L,prior}(n)$ stored in the layer L excitation buffer) translated by the (fractionally-refined) pitch lag from step (4); the fractional translation again derives from an interpolation. Thus, define $b_{128}(n)$ as a Hamming windowed sinc function filter truncated at ±127, and define:

$$v_L(n)=\Sigma_{0\leq j\leq 31}u_{L,prior}(n-k+j)b_{128}(m+4j)+\Sigma_{0\leq j\leq 31}u_{L,prior}(n-k+1+j)b_{36}(4-m+4j)$$

where k and m are the integer part and 4 times the fractional part, respectively, of the pitch lag found in the preceding step. Note that because higher layers will have fixed codebook vectors with more pulses, the excitations of higher layers should be better approximations of the residual.

(6) Determine the adaptive codebook gain for layer L, $g_{p,L}$, as the ratio of the correlation $\langle x|y_L\rangle$ divided by the energy $\langle y_L|y_L\rangle$ where x(n) is again the target signal in the subframe and $y_L(n)$ is the subframe synthesis signal generated by applying the weighted synthesis filter W(z)/Â(z) to the adaptive codebook vector $v_L(n)$ from the preceding step. Also, ⟨a|b⟩ denotes generally the inner (scalar) product of vectors a and b. Note that each layer L will have its own 1/Â(z) filter memory, and that this $g_{p,L}$ simply minimizes the error $\|x-g_{p,L}y\|$. More explicitly:

$$g_{p,L}=\Sigma_{0\leq n\leq 63}x(n)y_L(n)/\Sigma_{0\leq n\leq 63}y_L(n)y_L(n)$$

Thus $g_{p,L}V_L(n)$ is the layer L adaptive codebook contribution to the excitation and $g_{p,L}y_L(n)$ is the layer L adaptive codebook contribution to the synthesized speech in the subframe.

(7) The fixed (algebraic) codebook for each layer L has vectors $c_L(n)$ with 64 positions for the 64-sample subframes as the encoding granularity. The 64 samples are partitioned into four interleaved tracks with the number of pulses positioned within each track dependent upon the layer; layer L+1 incorporates the pulses of layer L and adds one more pulse in each track. The core layer has one pulse of ±1 on each track; and such a vector requires a total of 20 bits to encode: for each of the four tracks the pulse position in the track requires 4 bits and the ± sign requires one bit. Of course, other preferred embodiments may have different pulse allocations, such as a layer only adding a new pulse in only two of the four tracks, or adding more than one pulse in a track.

First, find the core layer (layer 0) fixed codebook vector $c_0(n)$ by essentially maximizing the correlations of the target signal for the core layer, $x(n)-g_{p,0}y_0(n)$, with possible multiple-pulse vectors filtered with F(z) and W(z)/Â(z) where F(z) is an adaptive pre-filter which enhances special spectral components. Indeed, take F(z) as a two-filter cascade of $1/(1-0.85z^{-T})$ and $(1-\beta_T z^{-1})$ where T is the integer part of the pitch lag and $\beta_T$ is related to the voicing of the previous subframe. Let h(n) denote the convolution of the impulse response of F(z) with the impulse response of W(z)/Â(z); the same F(z) and h(n) are used in all layers. Thus the fixed codebook search for the core layer maximizes the ratio of the square of the correlation $\langle x-g_{p,0}y_0|Hc\rangle$ divided by the energy $\langle c|H^THc\rangle$ where H is the lower triangular Toeplitz convolution matrix with diagonals h(0), h(1), . . . ; and c denotes a vector with four ±1 pulses, one in each track. As with the AMR-WB standard, search the codebook ($2^{20}$ entries) with a depth-first tree search for pairs of pulses in consecutive tracks.

In more detail, differentiation of the error with respect to the vector c(n) shows that if $c_j$ is the jth fixed codebook vector, then search the codebook to maximize the ratio of squared correlation to energy:

$$(x-g_p y)^t Hc_j)^2/c_j^t\Phi c_j=(d^t c_j)^2/c_j^t\Phi c^j$$

where $x-g_p y$ is the target signal vector updated by subtracting the adaptive codebook contribution, H is the 64×64 lower triangular Toeplitz convolution matrix with diagonal h(0) and lower diagonals h(1), . . . , h(63); the symmetric matrix $\Phi=H^tH$; and $d=H^t(x-g_p y)$ is a vector containing the correlation between the target vector and the impulse response (backward-filtered target vector). The vector d and the needed elements of matrix Φ are computed before the codebook search.

The 64-sample subframe is partitioned into 4 interleaved tracks of 16 samples each and c(n) has 4 pulses with 1 pulse in each of tracks 0, 1, 2, and 3.A simplification presumes that the sign of a pulse at position n is the same as the sign of b(n) which is defined in terms of r(n) (the residual) and d(n) as:

$$b(n)=\sqrt{(E_d/E_r)}r(n)+\alpha d(n)$$

where $E_d=\langle d|d\rangle$ is the energy of the signal d, $E_r=\langle r|r\rangle$ is the energy of the residual, and α is a scaling factor to control the dependence of the reference b(n) on d(n) and which is lowered as the number of pulses is increased; e.g., from 1 to 0.5.

To simplify the search the signs of b(n) are absorbed into d(n) and φ(m,n). First, define d'(n)=sign{b(n)}d(n); then the correlation $d^t c_k=\langle d|c_k\rangle=d'(m_0)+d'(m_1)+d'(m_2)+d'(m_3)$, where $m_k$ is the position of the pulse on track k. Similarly, the 16 nonzero terms of $c_j^t\Phi c_j$ can be simplified by absorbing the signs of the pulses (which are determined by position from b(n)) into the Φ elements; that is, replace φ(m,n) with sign{b(m)} sign{b(n)}Φ(m,n) which then makes $c_j^t\Phi c_j=\phi(m_0,m_0)+2\phi(m_0,m_1)+2\phi(m_0,m_2)+2\phi(m_0,m_3)+\phi(m_1,m_1)+2\phi(m_1,m_2)+2\phi(m_1,m_3)+\phi(m_2,m_2)+2\phi(m_2,m_3)+\phi(m_3,m_3)$. Thus store the 64 possible $\phi(m_j,m_j)$ terms plus the 1536 possible $2\phi(m_i,m_j)$ terms for i<j. Then the fixed codebook search is a search for the pattern of positions of the 4 pulses which maximizes the ratio of squared correlation to energy; and there are $2^{16}$ (=16*16*16*16) possible patterns for the positions of the 4 pulses.

The search for the pulse positions ($m_0$, $m_1$, $m_2$, $m_3$) proceeds with sequential maximization of pairs of positions; this reduces the number of patterns to search. First search for $m_2$ and $m_3$ with $m_2$ confined to the two maxima of d'(n) on track 2 but $m_3$ any of the 16 positions on track 3; that is, maximize the partial ratio of $(d'(m_2)+d'(m_3))^2$ divided by $\phi(m_2,m_2)+2\phi(m_2,m_3)+\phi(m_3,m_3)$ over the 2×16 allowed pairs ($m_2$,$m_3$). Once $m_2$ and $m_3$ are found, then find $m_0$ and $m_1$ by maximizing the ratio of $(d'(m_0)+d'(m_1)+d'(m_2)+d'(m_3))^2$ divided by $\phi(m_0,m_0)+2\phi(m_0,m_1)+2\phi(m_0,m_2)+2\phi(m_0,m_{3-4})+\phi(m_1,m_1)+2\phi(m_1,m_2)+2\phi(m_1,m_3)+\phi(m_2,m_2)+2\phi(m_2,m_3)+\phi(m_3,m_3)$ over the 16×16 pairs ($m_0$,$m_1$) with $m_2$ and $m_3$ as already determined. Thus this search gives a first pattern of pulse positions, ($m_0$,$m_1$,$m_2$,$m_3$), which maximizes the ratio. Next, cyclically repeat this two-step search for a maximum ratio three times: first for ($m_3$,$m_0$) plus ($m_1$,$m_2$); next, for ($m_4$,$m_2$) plus ($m_0$,$m_1$); and then for ($m_4$,$m_0$) plus ($m_1$,$m_2$). Finally, pick the pattern of pulse positions ($m_0$,$m_1$,$m_2$,$m_{3-4}$) which gave the largest of the four maximum ratios.

(8) Determine the core layer fixed codebook gain, $g_{c,0}$ by minimizing the mean error $\|x-g_{p,0}y_0-g_{c,0}z_0\|$ where, as in the foregoing description, x(n) is the target in the subframe, $g_{p,0}$ is the adaptive codebook gain for layer 0 (core layer), $y_0(n)$ is the $W(z)/\hat{A}(z)$ filter applied to the translated prior excitation $v_0(n)$, and $z_0(n)$ is $F(z)W(z)/\hat{A}(z)$ applied to the algebraic codebook vector $c_0(n)$; that is, convolution of h(n) with $c_0(n)$. Lastly, update the core layer buffer with the core layer excitation $u_0(n)=g_{p,0}v_0(n)+g_{c,0}c_0(n)$.

(9) For the first enhancement layer (layer 1), find the fixed codebook vector $c_1(n)$ by again maximizing the correlations of the target signal $x(n)-g_{p,1}y_1(n)$ with possible multiple-pulse vectors filtered with F(z) and $W(z)/\hat{A}(z)$. That is, again maximize the ratio of the square of the correlation $\langle x-g_{p,1}y_1|Hc\rangle$ divided by the energy $\langle c|H^THc\rangle$ where c denotes a vector with eight ±1 pulses, two in each track. However, of the two pulses in a track, one pulse is taken to be the same (position and sign) as a pulse in $c_0(n)$; that is, four of the pulses of $c_1(n)$ are inherited from $c_0(n)$, and the codebook search thus only needs to find the remaining four pulses of $c_1(n)-c_0(n)$. Again, search over pairs of pulses in successive tracks. Note that the ordering of steps (8) and (9) could be reversed because the core layer gain is not used in the layer 1 search.

(10) Analogous to step (8) for the core layer, determine the layer 1 fixed codebook gain, $g_{c,1}$ by minimizing the mean error $\|x-g_{p,1}y_1-g_{c,1}z_1\|$ where, as in the foregoing description, x(n) is the target in the subframe, $g_{p,1}$ is the adaptive codebook gain for layer 1, $y_1(n)$ is the $W(z)/\hat{A}(z)$ filter applied to $v_1(n)$, and $z_1(n)$ is $F(z)W(z)/\hat{A}(z)$ applied to the algebraic codebook vector $c_1(n)$; that is, convolution of h(n) with $c_1(n)$. Lastly, update the layer 1 buffer with the layer 1 excitation $u_1(n)=g_{p,1}v_1(n)+g_{c,1}c_1(n)$.

(11) Higher enhancement layers proceed similarly to the foregoing described in steps (9)-(10): for layer L first find the fixed codebook vector by maximizing the ratio of the square of $\langle x-g_{p,L}y_L|Hc\rangle$ divided by the energy $\langle c|H^THc\rangle$ where c denotes a vector with 4L pulses, L in each track. However, of the L pulses in a track, L−1 pulses are taken to be the same (position and sign) as pulses in $c_{L-1}(n)$; that is, all but four of the pulses of $c_L(n)$ are inherited from $c_{L-1}(n)$, and the codebook search is thus only needs to find the remaining four pulses of $c_L(n)-c_{L-1}(n)$. Again, search over pairs of pulses in successive tracks. And the fixed codebook gain is found by minimizing the error $\|x-g_{p,L}y_L-g_{c,L}z_L\|$ where, as in the foregoing description, x(n) is the target in the subframe, $g_{p,L}$ is the adaptive codebook gain for layer L, $y_L(n)$ is the $W(z)/\hat{A}(z)$ filter applied to the translated excitation $v_L(n)$ for layer L, and $z_L(n)$ is $F(z)W(z)/\hat{A}(z)$ applied to the algebraic codebook vector $c_L(n)$; that is, $z_L(n)$ is the convolution of h(n) with $c_L(n)$. Again, update the layer L buffer with the layer L excitation $u_L(n)=g_{p,L}v_L(n)+g_{c,L}c_L(n)$. Of course, the fixed codebook searches for a layer does not depend upon the gains of any lower layer, so the fixed codebook searches could all be performed prior to the fixed codebook gains.

(12) Encoding of the core layer parameters (ISPs, pitch lag, codebook gains, and algebraic codebook track indices) is similar to AMR-WB. For higher layers, only the codebook gains and algebraic codebook track indices need to be encoded. Encoding the gains for a layer can use the gains of that layer for prior (sub)frames as predictors, and encoding the algebraic codebook track indices only needs the four pulses added at each layer. Joint vector quantization of the adaptive and fixed codebook gains can be used for each layer.

Alternatives of the foregoing which still provide for the reuse of lower layer pulses in higher layers include the core layer having more or fewer pulses than 4 pulses in the fixed codebook vector and each enhancement layer adding more or fewer than 4 pulses to the fixed codebook vector.

3. Scaled Pulses

A second preferred embodiment coder follows the steps of the foregoing preferred embodiment encoder but with a change in the fixed codebook processing. In particular, it is beneficial to differentiate between pulses selected at the different encoding layers, and the second preferred embodiments scale the fixed-codebook pulses from the lower layers when they are considered as part of the fixed-codebook excitation in the higher layers. Generally, fixed-codebook pulses selected initially have higher perceptual importance than pulses selected subsequently; and in a preferred embodiment decoder for the bitstream (created by the preferred embodiment layered encoder) the order of pulse selection can be determined from the layer in which a pulse appears. To take advantage of this, the second preferred embodiment encoder includes the following steps:

(1) For the core layer, encode as described in foregoing first preferred embodiment steps (1)-(8); this yields $c_0(n)$.

(2) For layer 1 (first enhancement layer) find the adaptive codebook vector $v_1(n)$ and gain $g_{p,1}$ as described in foregoing first preferred embodiment. Then find the fixed codebook vector $c_1(n)$ by again maximizing the correlations of the target signal $x(n)-g_{p,1}y_1(n)$ with possible multiple-pulse vectors, c, filtered with F(z) and $W(z)/\hat{A}(z)$; however, the multiple-pulse vectors, c, have the form $c(n)=s_{10}c_0(n)+f_1(n)$ where $s_{10}$ is a scale factor (such as 1.5), $c_0(n)$ is the fixed-codebook vector from the core layer, and $f_1(n)$ is a four-pulse vector with one ±1 pulse in each track. That is, maximize the ratio of the square of $\langle x-g_{p,1}y_1|Hc\rangle$ divided by the energy $\langle c|H^THc\rangle$ where c denotes a vector with four $\pm s_0$ pulses at the positions and signs of $c_0(n)$ pulses together with four ±1 pulses at positions to be determined by the search; each track has one of each kind of pulse. Again, search over pairs of pulses for $f_1(n)$ in successive tracks.

(3) Analogous to the core layer, determine the layer 1 fixed codebook gain, $g_{c,1}$, by minimizing the mean error $\|x-g_{p,1}y_1-g_{c,1}z_1\|$ where, as in the foregoing description, x(n) is the target in the subframe, $g_{p,1}$, is the adaptive codebook gain for layer 1, $y_1(n)$ is the $W(z)/\hat{A}(z)$ filter applied to $v_1(n)$, and $z_1(n)$ is $F(z)W(z)/\hat{A}(z)$ applied to the algebraic codebook vector $c_1(n)$ which has four $\pm s_{10}$ pulses together with four ±1 pulses; that is, convolution of h(n) with $c_1(n)$. Lastly, update the layer 1 buffer with the layer 1 excitation $u_1(n)=g_{p,1}v_1(n)+g_{c,1}c_1(n)$.

(4) For layer 2 (second enhancement layer) find the adaptive codebook vector $v_2(n)$ and gain $g_{p,2}$ as described in foregoing first preferred embodiment. Then find the fixed codebook vector $c_2(n)$ by again maximizing the correlations of the target signal $x(n)-g_{p,2}y_2(n)$ with possible multiple-pulse vectors, c, filtered with F(z) and $W(z)/\hat{A}(z)$; however, the multiple-pulse vectors, c, have the form $c(n)=s_{20}c_0(n)+s_{21}[c_1(n)-s_{10}c_0(n)]+f_2(n)$ where $s_{20}$ is a scale factor larger than $s_{10}$, $c_0(n)$ is the fixed-codebook vector from the core layer, $s_{21}$ is a scale factor smaller than $s_{20}$, $c_1(n)$ is the fixed-codebook vector from layer 1, and $f_2(n)$ is a four-pulse vector with one ±1 pulse in each track. That is, maximize the ratio of the square of $\langle x-g_{p,2}y_2|Hc\rangle$ divided by the energy $\langle c|H^THc\rangle$ where c denotes a vector with four $s_{20}$ pulses at the positions and signs of $c_0(n)$ pulses, four $\pm s_{21}$ pulses at the positions and signs of pulses found in step (3) to form $c_1(n)$ pulses, together with four ±1 pulses at positions to be determined by the search; each track has one of each kind of pulse. Again, search over pairs of pulses for $f_2(n)$ in successive tracks.

(5) Again, determine the layer 2 fixed codebook gain, $g_{c,2}$, by minimizing the mean error $\|x-g_{p,2}y_2-g_{c,2}z_2\|$ where, as in the foregoing description, x(n) is the target in the subframe, $g_{p,2}$, is the adaptive codebook gain for layer 2, $y_2(n)$ is the $W(z)/\hat{A}(z)$ filter applied to $v_2(n)$, and $z_2(n)$ is $F(z)W(z)/\hat{A}(z)$ applied to the algebraic codebook vector $c_2(n)$ which has four $s_{20}$ pulses, four $s_{21}$ pulses, together with four ±1 pulses; that is, convolution of h(n) with $c_2(n)$. Lastly, update the layer 2 buffer with the layer 1 excitation $u_2(n)=g_{p,2}v_2(n)+g_{c,2}c_2(n)$.

(6) Continue in the same manner for the higher layers. For example, layer 3 has scales $s_{30}$, $s_{31}$, and $s_{32}$ and searches over vectors of the form $c(n)=s_{30}c_0(n)+s_{31}[c_1(n)-s_{10}c_0(n)]+s_{32}[c_2(n)-s_{20}c_0(n)-s_{21}c_1(n)]+f_3(n)$ where $f_3(n)$ has one ±1 pulse in each track.

An example of a second preferred embodiment coding with pulse scaling which gives good performance has a core layer with 4 pulses per subframe (one pulse per track), a first enhancement layer with 10 pulses per subframe (two pulses for each of tracks $T_0$ and $T_2$ and three pulses for each of tracks $T_1$ and $T_3$), a second enhancement layer with 18 pulses per subframe (four pulses for each of tracks $T_0$ and $T_2$ and five pulses for each of tracks $T_1$ and $T_3$), and a third enhancement layer with 24 pulses per subframe (six pulses per track). The scalings were: $s_{10}=s_{21}=s_{32}=1.375$, $s_{20}=s_{31}=1.75$, and $s_{30}=2.125$. Thus:

In the first enhancement layer scale the pulses derived from the core layer by 1.375;

In the second enhancement layer scale the pulses derived from the core layer by 1.75 and the pulses derived from the first enhancement layer by 1.375;

In the third enhancement layer scale the pulses derived from the core layer by 2.125, the pulses derived from the first enhancement layer by 1.75, and the pulses derived from the second enhancement layer by 1.375.

An alternative places less emphasis on lower layer pulses and simply scales all lower layer pulses by a factor such as 1.3.

4. Pitch Lag Optimization

Third preferred embodiments are analogous to the first and second preferred embodiments but change the pitch lag determination to optimize with respect to all layers, rather than just the core layer. In particular, for the pitch analysis described in step (4) of the first preferred embodiment, change the closed-loop search stages so the pitch analysis becomes:

(i) Estimate an open-loop integer pitch lag To by maximizing a normalized autocorrelation of the perceptually-weighted filtered pre-processed speech. Thus first define:

$$R'(k)=\Sigma_{0\leq n\leq 127}s_w(n)s_w(n-k)/\sqrt{(\Sigma_{0\leq n\leq 127}s_w(n-k)s_w(n-k))}$$

Then take the open-loop delay as $T_O=\arg\max_k R'(k)$; this is the same as with the first and second preferred embodiments.

(ii) For each layer L, refine the open-loop delay, $T_O$, with a closed-loop search which maximizes a normalized correlation of the target and the synthesized speech from integer pitch lag in a range of ±7 about $T_O$. Thus first define the normalized correlation:

$$R_L(k)=\Sigma_{0\leq n\leq 63}x(n)y_{L,k}(n)/\sqrt{(\Sigma_{0\leq n\leq 63}y_{L,k}(n)y_{L,k}(n)}$$

where k is in a range of ±7 about $T_O$, x(n) is the target signal, and $y_{L,k}(n)$ is the synthesis from filtering prior excitation at lag k (i.e., translated by a subframe and k) through the weighted synthesis filter $W(z)/\hat{A}(z)$. The signal $y_{L,k}(n)$ is computed by convolution of prior excitation at lag k of layer L with the impulse response of the weighted synthesis filter. Then the closed-loop optimal integer delay for layer L is arg $\max_k R_L(k)$.

(iii) Once the optimal integer delay for layer L is found, compute a fractional refinement for the fractions from −¾ to +¾ in steps of ¼ about the optimal integer delay by maximization of interpolated correlations. In particular, let $b_{36}(n)$ be a Hamming windowed sinc function filter truncated at ±35, and define:

$$R_L(k_L;m)=\Sigma_{0\leq j\leq 8}R_L(k_L-j)b_{36}(m+4j)+\Sigma_{0\leq j\leq 8}R_L(k_L+1+j)b_{36}(4-m+4j)$$

where $k_L$ is the optimal integer delay for layer L and m=0, 1, 2, 3 corresponds to fractional delays 0, ¼, ½, ¾. Then the fractional delay with integer delay $k_L$ corresponds to $m_L=\arg\max_m R_L(k_L; m)$, and the layer L candidate pitch lag for the subframe is then $k_L+mL/4$. There are N+1 candidate pitch lags, one from each layer.

(iv) For the candidate pitch lag from layer L, compute the adaptive codebook vector, $v_{ML}(n)$, for layer M as the prior subframe layer M excitation ($u_{M,prior}(n)$ stored in the layer M excitation buffer) translated by the candidate pitch lag from layer L; again, the fractional translation derives from an interpolation. That is, take:

$$v_{ML}(n)=\Sigma_{0\leq j\leq 31}u_{M,prior}(n-k_L+j)b_{128}(m_L+4j)+\Sigma_{0\leq j\leq 31}u_{M,prior}(n-k_L+1+j)b_{36}(4-m_L+4j)$$

where $k_L$ and $m_L$ are the integer part and 4 times the fractional part, respectively, of the candidate pitch lag from layer L. Next, compute the synthesized speech $y_{ML}(n)$ by filtering $v_{ML}(n)$ with the weighted synthesis filter $W(z)/\hat{A}(z)$. Then compute the normalized correlations $\langle X|y_{ML}\rangle/\sqrt{\langle y_{ML}|y_{ML}\rangle}$ and the resulting weighted sum (weight $w_M$ for layer M) using the layer L candidate pitch lag:

$$\Sigma_{0\leq M\leq N}w_M\langle x|y_{ML}\rangle/\sqrt{\langle y_{ML}|y_{ML}\rangle}$$

Lastly, pick the pitch lag as the candidate which maximizes the weighted sum.

The weights WM can be adjusted to improve the layered coder performance for a specific one or more layers. If best performance is desired for layer L, the weight wL should be set equal to 1 and all other weights should be set equal to 0. An alternative is for all weights to be equal. Various applications should have a variety of optimal weights.

5. Fixed Code Optimization

Fourth preferred embodiments are analogous to the first three preferred embodiments but find the fixed codebook vectors (innovation sequences of pulses) by searches which also take into account how the pulses impact higher layers. That is, in the other preferred embodiments a fixed codebook vector for a layer uses the pulses from the lower layers without change (except scaling), and then searches to find the pulses added in the current layer. In contrast, the fourth preferred embodiments perform pulse searches as follows. In computing the layer L pulses to be added to the lower layer pulses already used, for every considered choice of best performing pulse locations, first the corresponding normalized correlations between the target vector and the fixed-codebook pulse sequence (all pulses used in layer L) is computed for layer L plus the higher layers. That is, the layer L fixed-codebook search over vectors (pulse sequences) $c_j$ is to maximize the sum over layer L plus higher layers of weighted normalized correlations of corresponding target signals with $z_j(n)$=convolution of h(n) and $c_j(n)$. The normalized correlation for layer M (M=L, L+1, . . . , N) uses the layer M synthesis: $\langle x-g_{p,M}y_M|z_j\rangle/\sqrt{\langle z_j|z_j\rangle}$. Pick the vector $c_j$ for layer L which maximizes $\Sigma_{L\leq M\leq N}w'_M\langle x-g_{p,M}y_M|z_j\rangle/\sqrt{\langle z_j|z_j\rangle}$ where $w'_M$ is the weight for layer M and usually differs from the layer M weight $w_M$ for the third preferred embodiments.

A fourth preferred embodiment with larger weights for higher layers experimentally gave better performance. Such weighting puts emphasis in the lower layers to select the fixed-codebook pulses that contribute more efficiently to the fixed-codebook contribution of the higher layers. For example, a coder with a core layer and two enhancement layers, weights equal to 0.33 for the core layer, 0.77 for the first enhancement layer, and 1.0 for the second enhancement layer gave good results.

The complexity of the fourth preferred embodiment searches need not be significantly higher than that of the searches of AMR-WB in which the pulses are searched sequentially with a number of initial conditions that limit the sequences of pulses compared. The same sequence of initial conditions may be used in the preferred embodiments.

6. Decoder

A first preferred embodiment decoder and decoding method essentially reverses the encoding steps for a bitstream encoded by the preferred embodiment layered encoding method. In particular, presume layers 0 through L are being received and decoded.

(1) Decode the layer 0 parameters; namely, quantized LP coefficients, quantized pitch lag, quantized codebook gains, $\hat{g}_{p,0}$ and $\hat{g}_{c,0}$, and fixed codebook vector, $c_0(n)$, having one pulse per track per subframe.

(2) Compute the layer 0 excitation by (i) find $v_0(n)$ as the layer 0 excitation computed in the prior (sub)frame translated by the decoded current pitch lag and then (ii) form the layer 0 current excitation as $u_0(n)=g_{p,0}v_0(n)+g_{c,0}c_0(n)$. This excitation updates the layer 0 excitation buffer.

(3) Decode the layer 1 parameters; namely, quantized codebook gains, $\hat{g}_{p,1}$ and $\hat{g}_{c,1}$, which may be in the form of differentials from predictors from prior (sub)frames, and fixed codebook vector difference, $c_1(n)-c_0(n)$, having one pulse per track per subframe.

(4) Compute the layer 1 excitation by (i) find $v_1(n)$ as the layer 1 excitation computed in the prior (sub)frame translated by the decoded current pitch lag and then (ii) form the layer 1 current excitation as $u_1(n)=\hat{g}_{p,1}v_1(n)+\hat{g}_{c,1}c_1(n)$. This excitation updates the layer 1 excitation buffer.

(5) Repeat step (4) for successive layers 2 through L.

(6) Apply postprocessing such as pitch filtering (if flag is set), pre-filtering $c_L(n)$ with F(z) (if pitch lag is smaller than subframe size), anti-sparseness (only for sparse fixed codebook vectors), noise enhancement (a $\hat{g}_{c,L}$ smoothing), and pitch enhancement filtering of $c_L(n)$.

(7) Synthesize speech by applying the LP synthesis filter from step (1) to the layer L excitation from step (5) as enhanced by the postprocessing step (6) to yield $\hat{s}(n)$.

7. Modifications

The preferred embodiments may be modified in various ways while retaining the features of layered CELP coding with adaptive codebook searches in enhancement layers and weighted reuse of fixed codebook vector pulses from lower layers.

For example, instead of an AMR-WB type of CELP, a G.729 or other type of CELP could be used for the implementations; some enhancement layers may not have adaptive codebook searches and instead rely on the adaptive codebook of the immediately lower layer; the overall sampling rate, frame size, subframe structure, interpolation versus extraction for subframes, pulse track structure, LP filter order, filter parameters, codebook bit allocations, prediction methods, and so forth could be varied.

What is claimed is:

1. A method of layered CELP encoding, comprising:

(a) finding LP coefficients and pitch lags for a block of input signals;

(b) finding, in one layer, a first set of fixed codebook pulses for said block using said LP coefficients and said pitch lags plus a first excitation for a prior block;

(c) finding, in another layer, a second set of fixed codebook pulses for said block using said LP coefficients and said pitch lags plus said first set of pulses plus a second excitation for said prior block; and (d) encoding said LP coefficients, said pitch lags, said first set of pulses, and said second set of pulses, wherein said encoding comprises said layered CELP encoding with adaptive codebook and fixed codebook optimizations for each layer.

2. The method of claim 1, wherein:

said encoding said LP coefficients includes conversion to ISPs and ISFs plus quantization.

3. The method of claim 2, wherein:

said block includes four subframes;

said LP coefficients are found in three of said subframes by interpolation.

4. The method of claim 1, wherein:

said block includes four subframes;

said pitch lags are found in two of said subframes by interpolation.

5. A method of layered CELP encoding, comprising:

(a) finding LP coefficients for a block of input signals;

(b) finding open-loop pitch lag estimates for said block;

(c) for each layer L, finding a pitch lag for layer L using said open loop pitch lag and an excitation of said layer L for a prior block;

(d) for each layer M, finding a correlation of target input speech and speech synthesized using said pitch lag for layer L with an excitation of said layer M for a prior block;

(e) evaluating said correlations for all layers L and M to select pitch lags for said block;

(f) finding, in one layer, a first set of fixed codebook pulses for said block using said LP coefficients and said pitch lags plus a first excitation for a prior block;

(g) finding, in another layer, a second set of fixed codebook pulses for said block using said LP coefficients and said pitch lags plus said first set of pulses plus a second excitation for said prior block; and (h) encoding said LP coefficients, said pitch lags, said first set of pulses, and said second set of pulses, wherein said encoding comprises said layered CELP encoding with adaptive codebook and fixed codebook optimizations for each layer.

6. An apparatus for encoding of layered CELP, comprising:

(a) means for finding LP coefficients and pitch lags for a block of input signals;

(b) means for finding, in one layer, a first set of fixed codebook pulses for said block using said LP coefficients and said pitch lags plus a first excitation for a prior block;

(c) means for finding, in another layer, a second set of fixed codebook pulses for said block using said LP coefficients and said pitch lags plus said first set of pulses plus a second excitation for said prior block; and (d) means for encoding said LP coefficients, said pitch lags, said first set of pulses, and said second set of pulses, wherein said encoding comprises said layered CELP encoding with adaptive codebook and fixed codebook optimizations for each layer.

7. The apparatus of claim 6, wherein said encoding said LP coefficients includes conversion to ISPs and ISFs plus quantization.

8. The apparatus of claim 7, wherein:

said block includes four subframes;

said LP coefficients are found in three of said subframes by interpolation.

9. The apparatus of claim 6, wherein:

said block includes four subframes;

said pitch lags are found in two of said subframes by interpolation.

* * * * *

UNITED STATES PATENT AND TRADEMARK OFFICE

CERTIFICATE OF CORRECTION

PATENT NO. : 7,596,491 B1
APPLICATION NO. : 11/279932
DATED : September 29, 2009
INVENTOR(S) : Jacek Stachurski It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 835 days.

Signed and Sealed this

Twenty-eighth Day of September, 2010

David J. Kappos

David J. Kappos
*Director of the United States Patent and Trademark Office*